US010602600B2

(12) United States Patent
Steck et al.

(10) Patent No.: US 10,602,600 B2
(45) Date of Patent: Mar. 24, 2020

(54) HIGH VOLTAGE POWER SUPPLY CASING

(71) Applicant: Moxtek, Inc., Orem, UT (US)

(72) Inventors: Ricky B. Steck, West Jordan, UT (US); Gordon Ernest Smith, Sandy, UT (US); Eric Miller, Provo, UT (US); David S. Hoffman, Draper, UT (US)

(73) Assignee: Moxtek, Inc., Orem, UT (US)

( * ) Notice: Subject to any disclaimer, the term of this patent is extended or adjusted under 35 U.S.C. 154(b) by 2 days.

(21) Appl. No.: 16/173,204

(22) Filed: Oct. 29, 2018

(65) Prior Publication Data

US 2019/0182943 A1 Jun. 13, 2019

Related U.S. Application Data

(60) Provisional application No. 62/597,659, filed on Dec. 12, 2017.

(51) Int. Cl.
*H05G 1/06* (2006.01)
*H05G 1/10* (2006.01)

(52) U.S. Cl.
CPC ..... *H05G 1/06* (2013.01); *H05G 1/10* (2013.01)

(58) Field of Classification Search
CPC ..... H05G 1/06; H05G 1/10
See application file for complete search history.

(56) References Cited

U.S. PATENT DOCUMENTS

| | | | | |
|---|---|---|---|---|
| 5,621,780 | A * | 4/1997 | Smith | A61N 5/1001 378/65 |
| 6,487,273 | B1 | 11/2002 | Takenaka et al. | |
| 6,494,618 | B1 | 12/2002 | Moulton | |
| 9,282,622 | B2 | 3/2016 | Draper et al. | |
| 2002/0021784 | A1 | 2/2002 | Chornenky et al. | |
| 2008/0130834 | A1 | 6/2008 | Bosello | |
| 2017/0251545 | A1 | 8/2017 | Klinkowstein et al. | |

OTHER PUBLICATIONS

International Search Report dated Feb. 21, 2019, in International Application No. PCT/US2018/058189, filed Oct. 30, 2018; 3 pages.

* cited by examiner

*Primary Examiner* — David P Porta
*Assistant Examiner* — Fani Boosalis
(74) *Attorney, Agent, or Firm* — Thorpe, North & Western, LLP

(57) ABSTRACT

An x-ray source can include a housing with material with an atomic number of ≥42 and a thermal conductivity of ≥3 W/(m*K) to assist in removing heat from the x-ray source and to block x-rays emitted in undesirable directions. An x-ray source can include a shell that is electrically conductive and that encloses at least part of a voltage multiplier without enclosing a control circuit to minimize or eliminate electromagnetic interference in the control circuitry caused by the voltage multiplier. An x-ray source can include a negative voltage multiplier, a positive voltage multiplier, and a ground plane between the negative voltage multiplier and the positive voltage multiplier. The ground plane can minimize or eliminate electromagnetic interference between the negative voltage multiplier and the positive voltage multiplier. An air-filled channel, associated with the ground plane, can reduce weight of the x-ray source.

22 Claims, 6 Drawing Sheets

HIGH VOLTAGE POWER SUPPLY CASING

CLAIM OF PRIORITY

Figure 1:
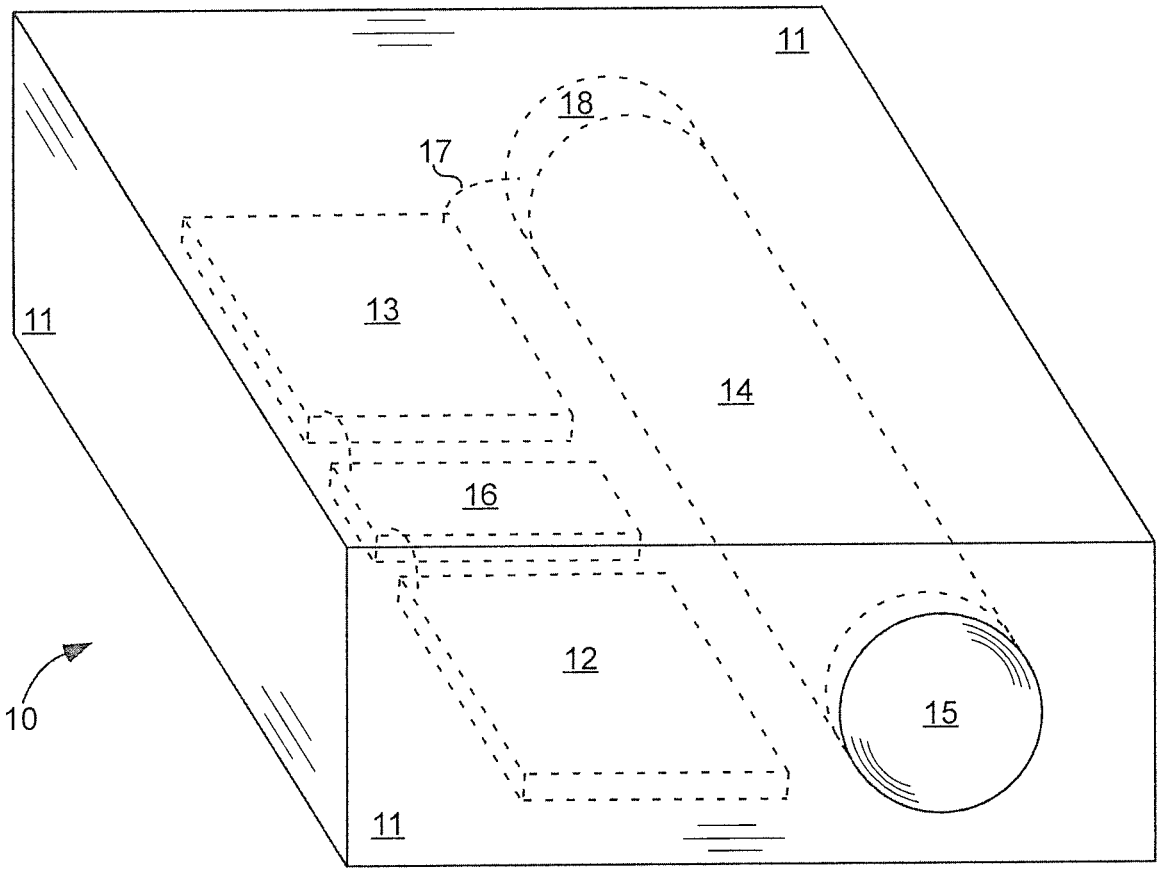

This application claims priority to U.S. Provisional Patent Application No. 62/597,659, filed on Dec. 12, 2017, which is incorporated herein by reference.

FIELD OF THE INVENTION

The present application is related generally to high voltage power supplies and to x-ray sources.

BACKGROUND

X-ray sources can emit x-rays in all or many directions. It can be important to block x-rays emitted in undesirable directions.

X-ray sources generate a substantial amount of heat. Kinetic energy of electrons hitting a target material on the anode can be converted to heat energy. Also, heat radiated from a filament can heat the anode. An overheated anode target can sublimate and the resulting gas can reduce an internal vacuum of the x-ray tube, thus causing it to fail. It can be important to remove this heat in order to avoid damage to the x-ray source.

Electromagnetic interference from voltage multipliers can interfere with nearby control circuitry. It can be important to prevent or minimize this interference.

Some devices, such as bipolar x-ray sources, include both a negative voltage multiplier and a positive voltage multiplier. It can be important to prevent or minimize electromagnetic interference between these voltage multipliers.

X-ray sources can be heavy due to use of high density material for blocking x-rays and electrical insulating material for isolation of a large voltage differential. Weight reduction can be another important aspect of x-ray sources, particularly portable x-ray sources.

SUMMARY

It has been recognized that it would be advantageous to remove heat from x-ray sources and to block x-rays emitted in undesirable directions. It has been recognized that it would be advantageous to minimize or eliminate electromagnetic interference in power supply control circuitry caused by a voltage multiplier. It has been recognized that it would be advantageous to minimize or eliminate electromagnetic interference between a negative voltage multiplier and a positive voltage multiplier. It has been recognized that it would be advantageous to reduce the weight of x-ray sources, particularly portable x-ray sources.

The present invention is directed to various embodiments of high voltage power supplies and x-ray sources that satisfy these needs. Each embodiment may satisfy one, some, or all of these needs.

In one embodiment, an x-ray source can include a housing comprising a material having an atomic number of ≥42 and a thermal conductivity of ≥3 W/(m*K). This housing can assist in removing heat from the x-ray source and can block x-rays emitted in undesirable directions.

In another embodiment, an x-ray source can include a shell that is electrically conductive and that encloses at least part of a voltage multiplier without enclosing a control circuit. This embodiment can minimize or eliminate electromagnetic interference in the control circuitry caused by the voltage multiplier.

In another embodiment, an x-ray source can include a negative voltage multiplier, a positive voltage multiplier, and a ground plane between the negative voltage multiplier and the positive voltage multiplier. This embodiment can minimize or eliminate electromagnetic interference between the negative voltage multiplier and the positive voltage multiplier.

BRIEF DESCRIPTION OF THE DRAWINGS (Notes: Drawings might not be drawn to scale. Components hidden inside the housing 11, the shell 21, the casing 22, and the enclosure 23 are shown with dashed lines)

FIG. 1 is a schematic perspective-view of x-ray source 10, comprising an x-ray tube 14; a power supply including a control circuit 12 and a voltage multiplier 13 and electrically coupled to the x-ray tube 14; and a housing 11 enclosing at least a portion of the x-ray tube 14 and the power supply; in accordance with an embodiment of the present invention.

Figure 2A:
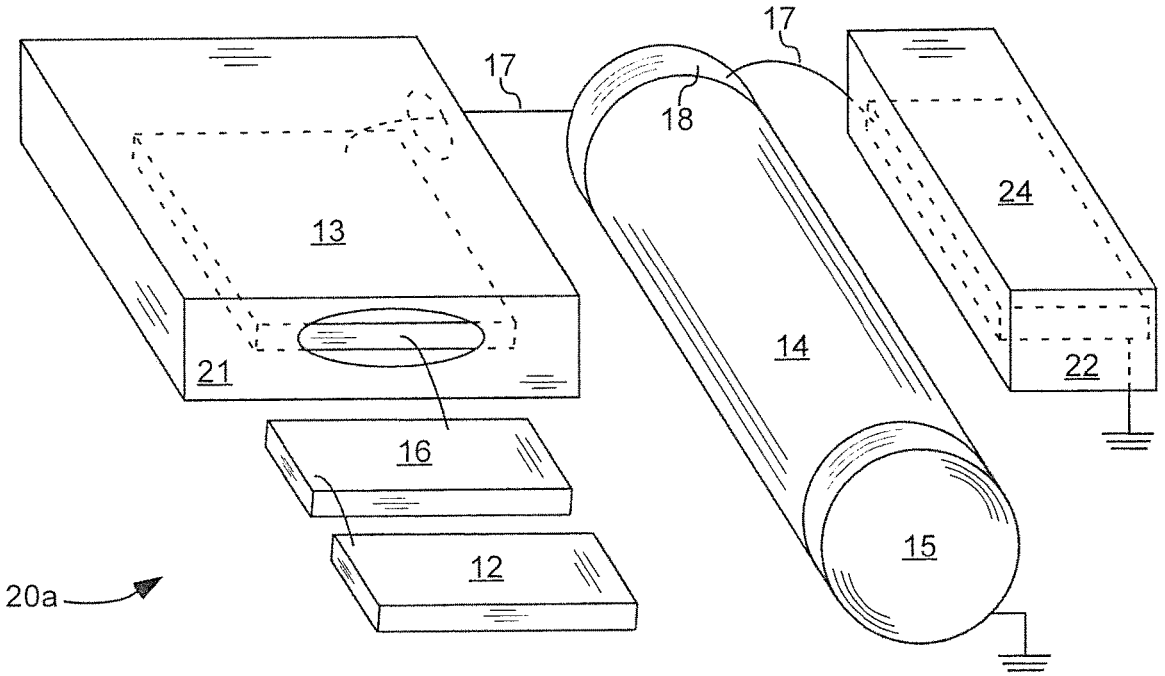

FIG. 2*a* is a schematic perspective-view of x-ray source 20*a*, comprising an x-ray tube 14 and a power supply electrically coupled to the x-ray tube 14, the power supply including a control circuit 12, a voltage multiplier 13, a transformer 16, and a shell 21, in accordance with an embodiment of the present invention.

Figure 2B:
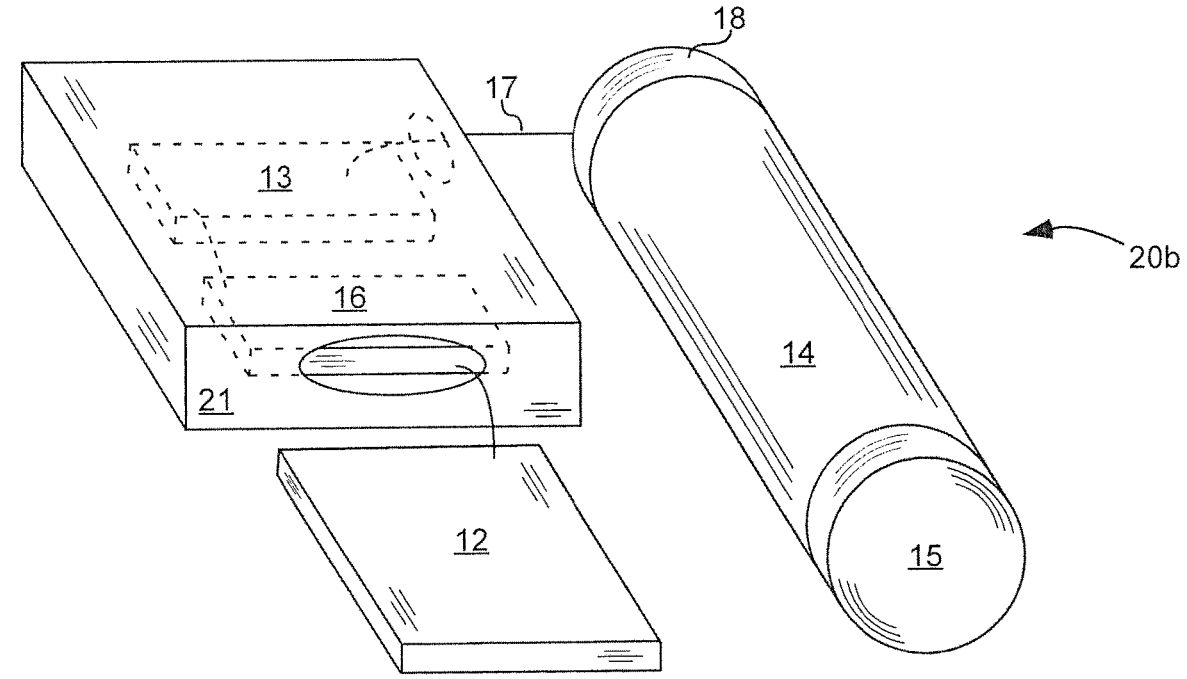

FIG. 2*b* is a schematic perspective-view of x-ray source 20*b*, similar to x-ray source 20*a*, except that the shell 21 also encloses at least a portion of the transformer 16 without enclosing the control circuit 12, in accordance with an embodiment of the present invention.

Figure 2C:
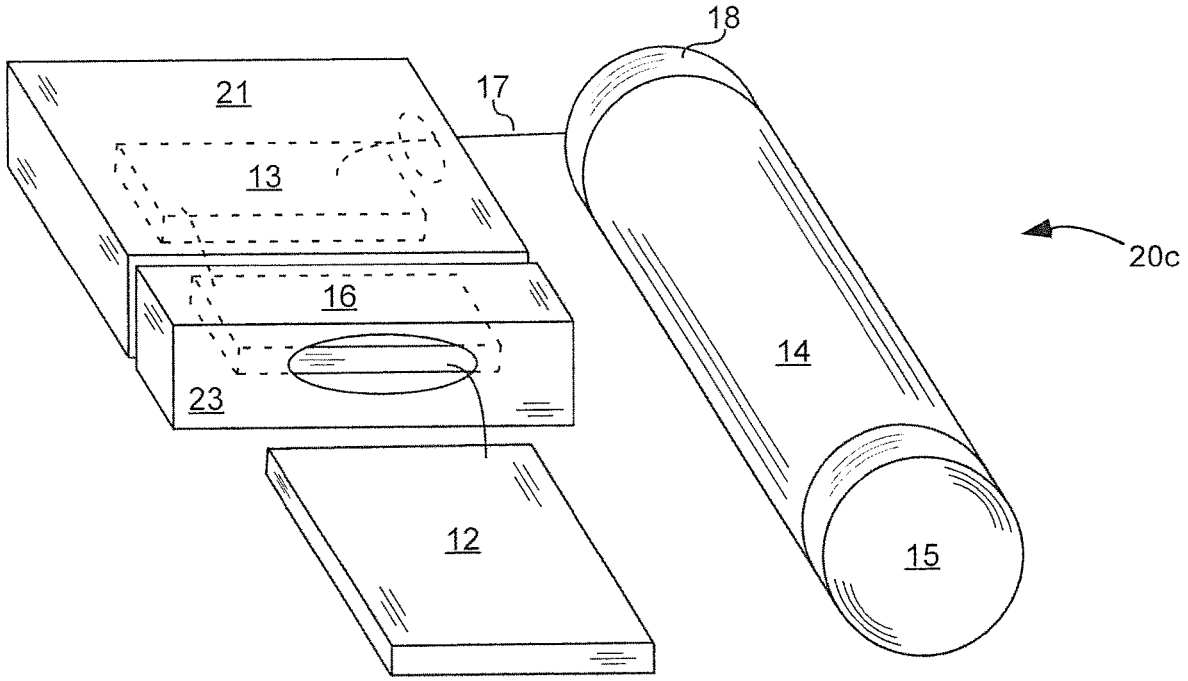

FIG. 2*c* is a schematic perspective-view of x-ray source 20*c*, similar to x-ray sources 20*a* and 20*b*, except that an enclosure 23, separate from the shell 21, also encloses at least a portion of the transformer 16 without enclosing the control circuit 12, in accordance with an embodiment of the present invention.

Figure 3:
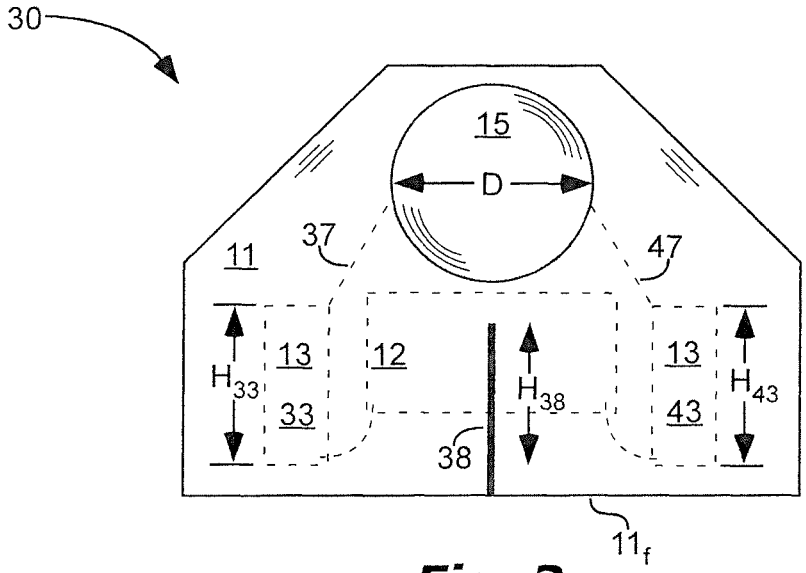

FIG. 3 is a schematic end-view of an x-ray source 30, comprising: an x-ray tube 14; a power supply electrically coupled to the x-ray tube 14, the power supply including a control circuit 12, a negative voltage multiplier 33, and a positive voltage multiplier 43; and a ground plane 38 between the negative voltage multiplier 33 and the positive voltage multiplier 43, in accordance with an embodiment of the present invention.

Figure 4:
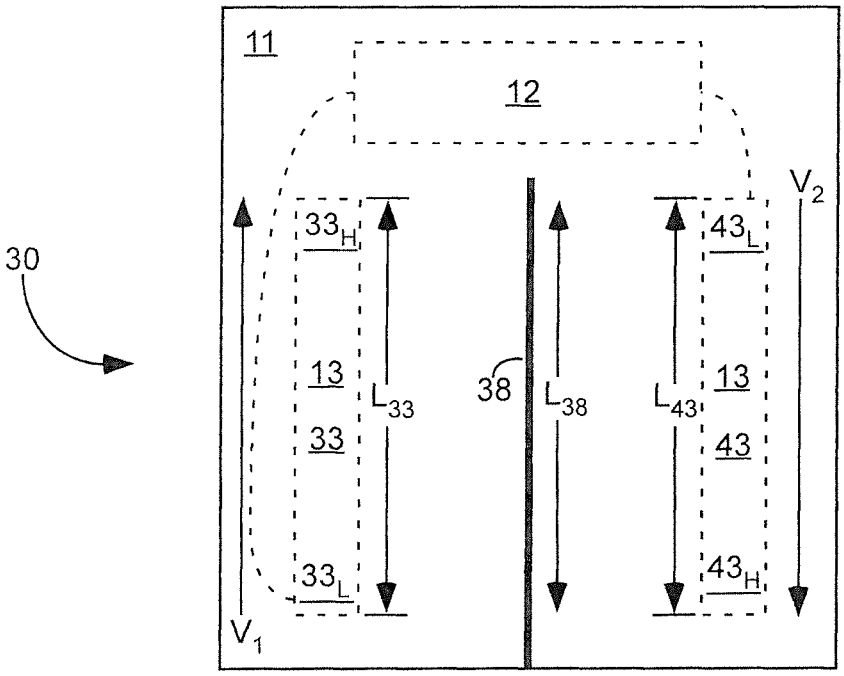

FIG. 4 is a schematic bottom-view of x-ray source 30, but not showing the x-ray tube 14 inside in order to more clearly show the ground plane 38, in accordance with an embodiment of the present invention.

Figure 5:
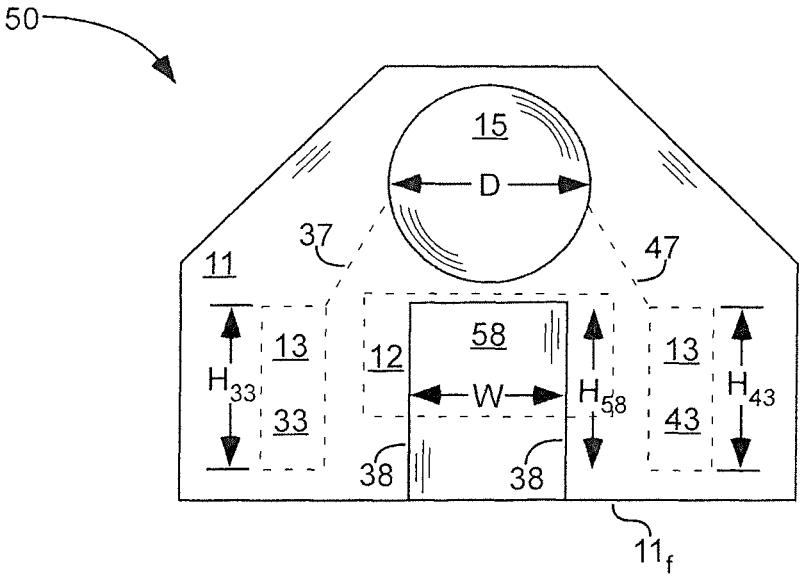

FIG. 5 is a schematic end-view of x-ray source 50, similar to x-ray source 30, further comprising an air-filled channel between the negative voltage multiplier and the positive voltage multiplier, defining an air gap 58, in accordance with an embodiment of the present invention.

Figure 6:
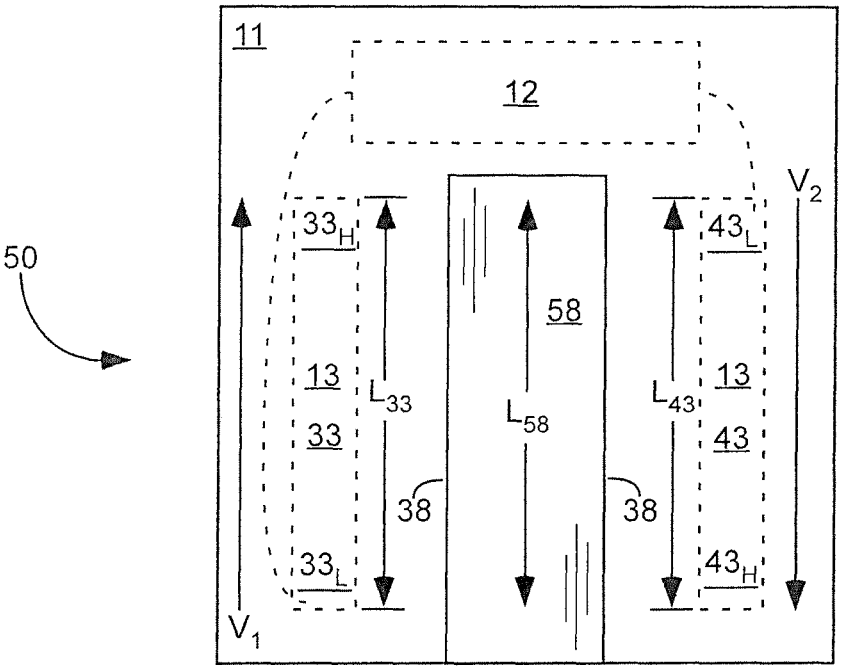

FIG. 6 is a schematic bottom-view of x-ray source 50, but not showing the x-ray tube 14 inside in order to more clearly show the air gap 58, in accordance with an embodiment of the present invention.

Figure 7:
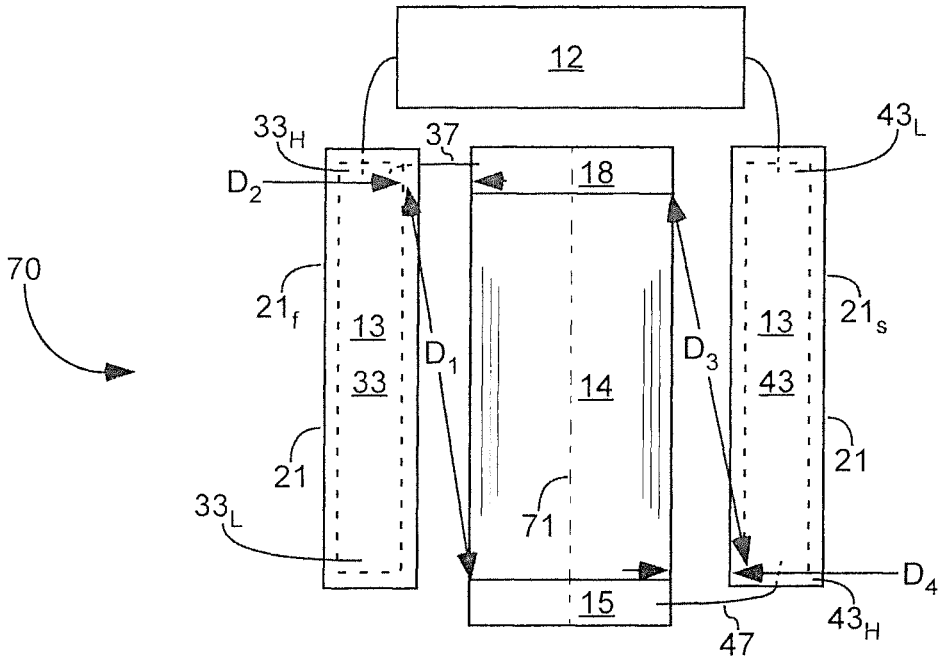

FIG. 7 is a schematic top-view of x-ray source 70, similar to x-ray sources 30 and 50, but without the housing 11 to more clearly show internal components, and further comprising a first shell $\mathbf{21}_f$ enclosing at least part of the negative voltage multiplier 33 and a second shell $\mathbf{21}_s$ enclosing at least part of the positive voltage multiplier 43, in accordance with an embodiment of the present invention.

Figure 8:
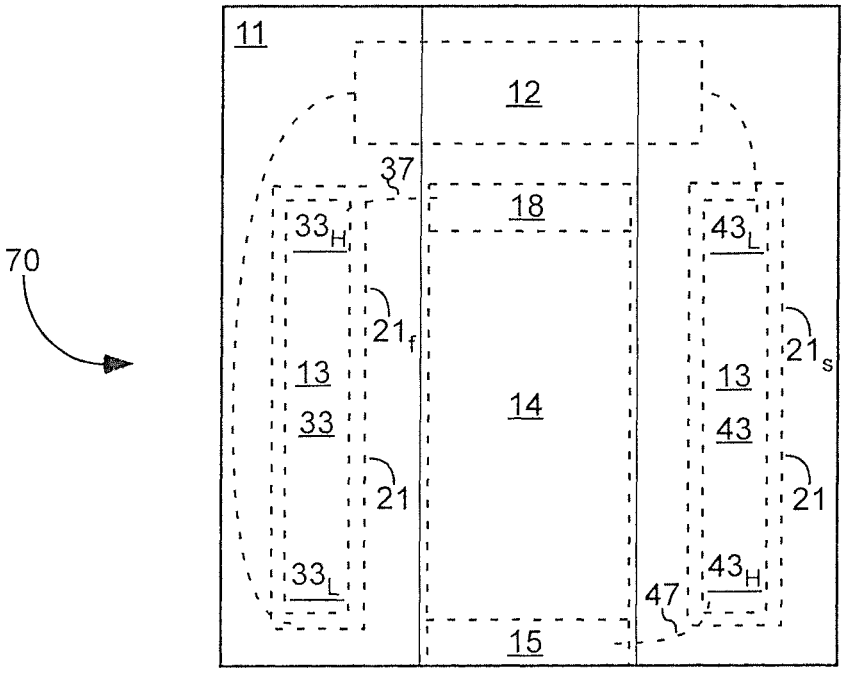

FIG. 8 is also a schematic top-view of x-ray source 70, but with the housing 11, in accordance with an embodiment of the present invention.

DEFINITIONS

As used herein, the unit "μ" is a unit of magnetic permeability and is equivalent to henries per meter (H/m) or to newtons per ampere squared ($N/A^2$).

As used herein, the term "kV" means kilovolt(s).

As used herein, the terms "low voltage" and "high voltage" refer to an absolute value of the voltage, unless specified otherwise. Thus, both −20 kV and +20 kV would be "high voltage" relative to −2 kV and +2 kV.

As used herein, the term "opposite directions" means exactly opposite, such that an angle between the opposite directions would be 180°, or substantially opposite, such that an angle between the opposite directions would be ≥150° and ≤210°. The angle between the opposite directions can also be ≥160°, ≥170°, or ≥175° and ≤185°, ≤190°, or ≤200° if explicitly so stated.

As used herein, the term "parallel" means exactly parallel, or substantially parallel, such that planes or vectors associated with the devices in parallel would intersect with an angle of ≤30°. Such planes or vectors can also be ≤5°, ≤10°, or ≤20° if explicitly so stated.

As used herein, the term "x-ray tube" is not limited to tubular/cylindrical shaped devices. The term "tube" is used because this is the standard term used for x-ray emitting devices.

DETAILED DESCRIPTION

As illustrated in FIG. 1, an x-ray source 10 is shown comprising a power supply electrically coupled to an x-ray tube 14. The power supply can include a voltage multiplier 13 and a control circuit 12. The power supply can also include a transformer 16. The x-ray tube 14 can include a cathode 18 and an anode 15 electrically insulated from one another. The cathode 18 can be configured to emit electrons towards the anode 15; and the anode 15 can be configured to emit x-rays out of the x-ray tube 14 in response to impinging electrons from the cathode 18. Transmission target anodes 15 are shown in the figures, but the inventions herein are also applicable to side window x-ray tubes.

A housing 11 can enclose at least a portion of the x-ray tube 14 and the power supply. For example, the housing 11 can enclose ≥25%, ≥50%, ≥70%, ≥90%, or ≥95%, of the x-ray tube 14, power supply, or both.

X-ray sources can emit x-rays in all or many directions. It can be important to block x-rays emitted in undesirable directions. The housing 11 can assist in blocking such x-rays by its material of construction including material with an atomic number of ≥42, ≥73, or ≥74. This material with the high atomic number can be a single chemical element or multiple, different chemical elements.

A higher weight percent of this material with the high atomic number can block a higher percent of x-rays, but also can increase the cost and weight of the housing. Therefore, a need to block x-rays can be balanced against cost and weight to determine the amount of this material with the high atomic number compared to other material of the housing 11. For example, ≥10 weight percent, ≥25 weight percent, ≥50 weight percent, ≥75 weight percent, or ≥90 weight percent of the housing 11 can be the material with the high atomic number of ≥42, ≥73, or ≥74. This material with the high atomic number can comprise plastic impregnated with tungsten, tantalum, molybdenum, other material with high atomic number of ≥42, ≥73, or ≥74, or combinations thereof. The housing 11 can be designed, based on x-ray tube 14 voltage, thickness of the housing 11, and material of the housing 11, to block ≥99%, ≥99.8%, or ≥99.98% of incoming x-rays.

X-ray sources generate a substantial amount of heat. It can be important to remove this heat, particularly from the anode 15. The housing 11 can aid in removal of this heat by making the housing 11 of material with a relatively high thermal conductivity. For example, the housing can be made of material with a thermal conductivity of ≥3 W/(m*K), ≥10 W/(m*K), ≥20 W/(m*K), ≥40 W/(m*K), ≥70 W/(m*K), or ≥100 W/(m*K). Plastic impregnated with metal can have such properties.

It can also be important for the housing 11 to be electrically conductive. A housing 11 that is electrically conductive can shield electromagnetic interference and can be electrically grounded for safety. For example, the housing 11 can have a surface electrical resistivity of ≤100 ohms per square, ≤10 ohms per square, ≤1 ohm per square, ≤0.1 ohms per square, or ≤0.01 ohms per square.

Housing 11 material with a high atomic number, that is thermally conductive, and that is electrically conductive can be a plastic impregnated with metal. For example, one potential material is Ecomass® 1080TU95 Tungsten Filled Polyamide supplied by Ecomass Technologies in Austin, Tex.

The power supply can include a voltage multiplier 13 and a control circuit 12. The voltage multiplier 13 can be configured to generate a large absolute value of bias voltage (represented by reference number 17), such as for example ≥500 volts, ≥1 kV, ≥2 kV, ≥10 kV, or ≥30 kV.

The bias voltage 17 is shown electrically coupled to the cathode 18 in FIGS. 1-2*c*; however, if the bias voltage 17 is positive, it could be electrically coupled to the anode 15. The voltage multiplier 13 can be any voltage multiplier/generator capable of receiving an input voltage and multiplying that voltage to generate the needed high voltage. For example, the voltage multiplier 13 described herein can be a Cockcroft-Walton multipliers/generators. The control circuit 12 can be configured to provide and control electrical power for the voltage multiplier 13. The control circuit 12 can also include an electronic circuit to provide and control electrical power for an electron emitter associated with a cathode 18 of the x-ray tube 14. The power supply can also include a transformer 16 configured to receive electrical power from the control circuit 12 and to provide electrical power to the voltage multiplier 13.

Electromagnetic interference from the voltage multiplier 13 can interfere with the control circuit 12. It can be important to prevent or minimize this interference. As illustrated in FIGS. 2*a*-2*c*, a shell 21 can enclose at least part of the voltage multiplier 13 without enclosing the control circuit 12 and can prevent or minimize this electromagnetic interference. For example, the shell 21 can enclose ≥25%, ≥40%, ≥60%, ≥. 70%, ≥80%, ≥90%, or ≥95% of the voltage multiplier 13 without enclosing the control circuit 12. As another example, the shell 21 can partly or totally enclose the voltage multiplier 13 on three sides, four sides, or five sides without enclosing the control circuit 12. As another example, the shell 21 can partly enclose the voltage multiplier 13 on six sides without enclosing the control circuit 12.

For improved functionality, the shell 21 can be electrically conductive, can have reasonably high magnetic permeability, or both. For example, the shell 21 can have electrical resistivity ≤1 Ω*m, ≤0.1 Ω*m, ≤$10^{-4}$ Ω*m, ≤$10^{-6}$ Ω*m, or $\leq 10^{-8}$ Ω*m. For example, the shell 21 can have magnetic permeability of $\geq 10^{-5}\mu$, $\geq 5.0\times 10^{-5}\mu$, $\geq 10^{-4}\mu$, $\geq 10^{-3}\mu$, or $\geq 10^{-2}\mu$.

For improved functionality, the shell 21 can be maintained at or near ground voltage. For example, the shell 21 can be maintained within 200 volts, within 100 volts, within 50 volts, within 20 volts, within 10 volts, or within 2 volts from ground voltage. Solid electrically insulative material can be located between the voltage multiplier 13 and the shell 21 and can electrically insulate the voltage multiplier 13 from the shell 21.

As illustrated in FIG. 2*a*, the transformer 16 can be located outside of the shell 21. Alternatively as illustrated in FIG. 2*b*, the shell 21 can enclose at least part of the transformer 16. Alternatively as illustrated in FIG. 2*c*, an enclosure 23 that is separate from the shell 21 can enclose at least a portion of the transformer 16 without enclosing the control circuit 12. For example, the enclosure 23 can enclose ≥25%, ≥40%, ≥60%, ≥70%, ≥80%, ≥90%, or ≥95% of the transformer 16 without enclosing the control circuit 12. For improved functionality, the enclosure 23 can be electrically conductive, can have reasonably high magnetic permeability, or both, with possible values of electrical resistivity and magnetic permeability as described above for the shell 21.

Electromagnetic interference from a voltage sensing resistor 24 can interfere with the control circuit 12. As illustrated in FIG. 2*a*, a voltage sensing resistor 24 can be configured to determine a voltage differential between the cathode 18 and the anode 15. A casing 22 can enclose at least a portion of the voltage sensing resistor 24 without enclosing the control circuit 12. For example, the casing 22 can enclose ≥25%, ≥40%, ≥60%, ≥70%, ≥80%, ≥90%, or ≥95% of the voltage sensing resistor 24 without enclosing the control circuit 12. For improved functionality, the casing 22 can be electrically conductive and/or can have reasonably high magnetic permeability, with possible values of electrical resistivity and magnetic permeability as described above for the shell 21.

As illustrated in FIGS. 3-8, the voltage multiplier 13 in bipolar x-ray sources 30, 50, and 70 can include a negative voltage multiplier 33 and a positive voltage multiplier 43. The negative voltage multiplier 33 can multiply an input electrical voltage to produce a negative bias voltage (represented by reference number 37), which can be a large voltage, such as for example ≤−500 volts, ≤−1 kV, ≤−2 kV, ≤−10 kV, or ≤−30 kV. The negative voltage multiplier 33 can have an end with a lowest absolute value of voltage, defining a negative low voltage end $\mathbf{33}_L$, and an end with a highest absolute value of voltage, defining a negative high voltage end $\mathbf{33}_H$. The negative voltage multiplier 33 can be electrically coupled from its negative high voltage end $\mathbf{33}_H$ to the cathode 18 and can provide electrical power to the cathode 18 at the negative bias voltage 37.

The positive voltage multiplier 43 can multiply an input electrical voltage to produce a positive bias voltage (represented by reference number 47), which can be a large voltage, such as for example ≥500 volts, ≥1 kV, ≥2 kV, ≥10 kV, or ≥30 kV. The positive voltage multiplier 43 can have an end with a lowest voltage, defining a positive low voltage end $\mathbf{43}_L$, and an end with a highest voltage, defining a positive high voltage end $\mathbf{43}_H$. The positive voltage multiplier 43 can be electrically coupled from its positive high voltage end $\mathbf{43}_H$ to the anode 15 and can provide electrical power to the anode 15 at the positive bias voltage 47.

It can be important to prevent or minimize electromagnetic interference between the negative voltage multiplier 33 and the positive voltage multiplier 43. As illustrated in FIGS. 3-6, a ground plane 38, located between the negative voltage multiplier 33 and the positive voltage multiplier, can prevent or minimize such electromagnetic interference. The ground plane 38 can be at or near ground voltage, such as for example within 1 volt of ground voltage, within 10 volts of ground voltage, within 100 volts of ground voltage, or within 200 volts of ground voltage.

The ground plane 38 can be optimally located to prevent or minimize electromagnetic interference between the negative voltage multiplier 33 and the positive voltage multiplier 43. For example, as shown in FIG. 4, a length $L_{33}$ of the negative voltage multiplier 33, a length $L_{43}$ of the positive voltage multiplier 43, and a length $L_{38}$ of the ground plane 38 can be parallel to each other. The length $L_{33}$ of the negative voltage multiplier 33 extends from the negative low voltage end $\mathbf{33}_L$ to the negative high voltage end $\mathbf{33}_H$. The length $L_{43}$ of the positive voltage multiplier 43 extends from the positive low voltage end $\mathbf{43}_L$ to the positive high voltage end $\mathbf{43}_H$. The length $L_{38}$ of the ground plane 38 is a distance parallel to the length $L_{33}$ of the negative voltage multiplier 33, parallel to the length $L_{43}$ of the positive voltage multiplier 43, and between the negative voltage multiplier 33 and the positive voltage multiplier 43. As another example, an x-ray tube axis 71 (see FIG. 7), extending from an electron emitter associated with the cathode 18 to a target material associated with the anode 15, can be parallel to the length $L_{33}$ of the negative voltage multiplier 33, to the length of the positive voltage multiplier $L_{43}$, and to the length $L_{38}$ of the ground plane 38.

The ground plane 38 can be located between all or a large portion of a plane between and parallel to the negative voltage multiplier 33 and the positive voltage multiplier 43. For example, as shown in FIG. 4, the length $L_{38}$ of the ground plane 38 can be ≥0.3 times, ≥0.5 times, ≥0.7 times, ≥0.9 times, or ≥1.1 times the length $L_{33}$ of the negative voltage multiplier 33 and ≥0.3 times, ≥0.5 times, ≥0.7 times, ≥0.9 times, or ≥1.1 times the length $L_{43}$ of the positive voltage multiplier 43. As another example, as shown in FIG. 3, a height $H_{38}$ of the ground plane 38 can be ≥0.3 times, ≥0.5 times, ≥0.7 times, ≥0.9 times, or ≥1.1 times a height $H_{33}$ of the negative voltage multiplier 33 and ≥0.3 times, ≥0.5 times, ≥0.7 times, ≥0.9 times, or ≥1.1 times a height $H_{43}$ of the positive voltage multiplier 43. The height $H_{38}$ of the ground plane 38 can be perpendicular to the length $L_{38}$ of the ground plane 38, can be between the negative voltage multiplier 33 and the positive voltage multiplier 43, and can extend between an outer face $\mathbf{11}_f$ of the housing 11 and the x-ray tube 14. The height $H_{33}$ of the negative voltage multiplier 33 and the height $H_{33}$ of the positive voltage multiplier 43 can be parallel to the height $H_{38}$ of the ground plane 38.

X-ray sources can be heavy due to use of high density components for blocking x-rays and electrical insulating material for isolation of large voltage differentials. Weight reduction can be another important aspect of x-ray sources, particularly portable x-ray sources. As shown in on x-ray source 50 in FIGS. 5-6, an air-filled channel, defining an air gap 58, can be located between the negative voltage multiplier 33 and the positive voltage multiplier 43. The air gap 58 can be used to both isolate the negative voltage multiplier 33 from the positive voltage multiplier 43 and to reduce the weight of the x-ray source.

A relatively wide air gap 58 can be helpful for optimal isolation of the negative voltage multiplier 33 from the positive voltage multiplier 43 and reduction of the weight of the x-ray source; but can also undesirably contribute to overall x-ray source size. Thus, the needs of each application can be reviewed to determine optimal size of the air gap 58. For example, the air gap 58 can have a width W between the negative voltage multiplier 33 and the positive voltage multiplier that is ≥10%, ≥25%, ≥50%, or ≥75% of a diameter D of the x-ray tube 14 and/or ≤80%, ≤100%, ≤150%, or ≤200% of the diameter D of the x-ray tube. As used herein, the term "diameter" of the x-ray tube 14 means a largest width if the x-ray tube 14 is not cylindrical.

The air gap 58 can be associated with the ground plane 38. For example, walls of the ground plane 38 can form the air gap 58. The walls of the ground plane 38 can surround the air gap 58 on three sides. The length of the ground plane 38 $L_{38}$ and a length $L_{58}$ of the air gap 58 can be parallel to each other. The length $L_{58}$ of the air gap 58 is a longest dimension of the air gap 58 between the negative voltage multiplier 33. The length $L_{58}$ of the air gap 58 can be within 80%-120% of the length $L_{38}$ of the ground plane 38.

A height $H_{58}$ of the air gap 58 can be within 80%-120% of the height $H_{38}$ of the ground plane 38. The height $H_{58}$ of the air gap 58 can be perpendicular to the length $L_{58}$ of the air gap 58, can be between the negative voltage multiplier 33 and the positive voltage multiplier 43, and can extend between an outer face $\mathbf{11}_f$ of the housing 11 and the x-ray tube 14. The height $H_{58}$ of the air gap 58 can be similar to the height $H_{33}$ of the negative voltage multiplier 33 and the height $H_{43}$ of the positive voltage multiplier 43. For example, the height $H_{58}$ of the air gap 58 can be ≥0.3 times, ≥0.5 times, ≥0.7 times, ≥0.9 times, or ≥1.1 times the height $H_{33}$ of the negative voltage multiplier 33 and/or can be ≥0.3 times, ≥0.5 times, ≥0.7 times, ≥0.9 times, or ≥1.1 times the height $H_{43}$ of the positive voltage multiplier 43. The height $H_{33}$ of the negative voltage multiplier 33 and the height $H_{43}$ of the positive voltage multiplier 43 can be parallel to the height of the air gap 58.

As illustrated in FIGS. 7-8, the shell 21 in bipolar x-ray source 70 can include a first shell $\mathbf{21}_f$ enclosing at least part of the negative voltage multiplier 33 and a second shell $\mathbf{21}_s$ enclosing at least part of the positive voltage multiplier 43. For example, the first shell $\mathbf{21}_f$ can enclose ≥25%, ≥40%, ≥60%, ≥70%, ≥80%, ≥90%, or ≥95% of the negative voltage multiplier 33 without enclosing the control circuit 12 and/or the second shell $\mathbf{21}_s$ can enclose ≥25%, ≥40%, ≥60%, ≥70%, ≥80%, ≥90%, or ≥95% of the positive voltage multiplier 43 without enclosing the control circuit 12. Note that for clarity of showing other components, the first shell $\mathbf{21}_f$ and the second shell $\mathbf{21}_s$ are not shown in FIGS. 3-6, but these shells $\mathbf{21}_f$ and $\mathbf{21}_s$ can be included in these embodiments.

As illustrated in FIGS. 4, 6-7, the negative voltage multiplier 33, the positive voltage multiplier 43, and the x-ray tube 14 can be arranged to optimize electrical field gradients, and thus reduce the chance of arcing failure of the x-ray source. For example, a first vector $V_1$ can extend from the negative low voltage end $\mathbf{33}_L$ to the negative high voltage end $\mathbf{33}_H$; a second vector $V_2$ can extend from the positive low voltage end $\mathbf{43}_L$ to the positive high voltage end $\mathbf{43}_H$; and the first vector $V_1$ and the second vector $V_2$ can be parallel and can extend in opposite directions. As another example, the negative high voltage end $\mathbf{33}_H$ can be located closer than the positive high voltage end $\mathbf{43}_H$ to the cathode 18 (i.e. $D_2<D_3$). As another example, a smallest distance $D_3$ between the positive high voltage end $\mathbf{43}_H$ and the cathode 18 divided by a smallest distance $D_2$ between the negative high voltage end $\mathbf{33}_H$ and the cathode 18 ($D_3/D_2$) can be ≥1.5, ≥2, ≥3, ≥4, or ≥5. As another example, the positive high voltage end $\mathbf{43}_H$ can be located closer than the negative high voltage end $\mathbf{33}_H$ to the anode 15 (i.e. $D_4<D_1$). As another example, a smallest distance D1 between the negative high voltage end $\mathbf{33}_H$ and the anode 15 divided by a smallest distance $D_4$ between the positive high voltage end $\mathbf{43}_H$ and the anode 15 ($D_1/D_4$) can be ≥1.5, ≥2, ≥3, ≥4, or ≥5.

What is claimed is:

1. An x-ray source comprising:

an x-ray tube configured to emit x-rays;

a power supply, including a voltage multiplier, electrically coupled to the x-ray tube;

a housing enclosing at least a portion of the x-ray tube and the power supply including the voltage multiplier, the housing comprising a material having an atomic number of ≥42 and a thermal conductivity of ≥3 W/(m*K).

2. The x-ray source of claim 1, further comprising:

the x-ray tube including a cathode and an anode electrically insulated from one another; the cathode configured to emit electrons towards the anode; and the anode configured to emit x-rays out of the x-ray tube in response to impinging electrons from the cathode;

the power supply including a negative voltage multiplier and a positive voltage multiplier;

the negative voltage multiplier is capable of multiplying an input electrical voltage to produce a negative bias voltage having a value of ≤−2 kV, is electrically coupled to the cathode, and is capable of providing electrical power to the cathode at the negative bias voltage;

the positive voltage multiplier is capable of multiplying an input electrical voltage to produce a positive bias voltage having a value of ≥2 kV, is electrically coupled to the anode, and is capable of providing electrical power to the anode at the positive bias voltage; and an air-filled channel between the negative voltage multiplier and the positive voltage multiplier, defining an air gap.

3. The x-ray source of claim 1, further comprising:

the x-ray tube including a cathode and an anode electrically insulated from one another; the cathode configured to emit electrons towards the anode; and the anode configured to emit x-rays out of the x-ray tube in response to impinging electrons from the cathode;

the power supply includes a negative voltage multiplier and a positive voltage multiplier;

the negative voltage multiplier is capable of multiplying an input electrical voltage to produce a negative bias voltage having a value of ≤−2 kV, is electrically coupled to the cathode, and is capable of providing electrical power to the cathode at the negative bias voltage;

the positive voltage multiplier is capable of multiplying an input electrical voltage to produce a positive bias voltage having a value of ≥2 kV, is electrically coupled to the anode, and is capable of providing electrical power to the anode at the positive bias voltage; and a ground plane, being within 100 volts of ground voltage, between the negative voltage multiplier and the positive voltage multiplier.

4. The x-ray source of claim 1, wherein ≥50 weight percent of the housing is the material with the atomic number of ≥42.

5. The x-ray source of claim 1, wherein the material composition has thermal conductivity of ≥10 W/(m*K).

6. The x-ray source of claim 1, wherein the material composition has electrical resistivity of ≤10 ohm per square.

7. The x-ray source of claim 1, wherein the housing encloses ≥90% of the x-ray tube and ≥90% of the power supply.

8. The x-ray source of claim 1, wherein the material having the atomic number of ≥42 includes material with an atomic number of ≥74.

9. The x-ray source of claim 1, wherein the power supply comprises:

a voltage multiplier configured to generate a voltage of ≥1 kV;

a control circuit configured to provide and control electrical power for the voltage multiplier; and a shell being electrically conductive and enclosing ≥40% of the voltage multiplier without enclosing the control circuit.

10. An x-ray source comprising:

an x-ray tube configured to emit x-rays; and a power supply electrically coupled to the x-ray tube, the power supply including:

a voltage multiplier configured to generate a voltage with an absolute value of ≥1 kV;

a control circuit configured to provide and control electrical power for the voltage multiplier; and a shell being electrically conductive and enclosing ≥40% of the voltage multiplier without enclosing the control circuit.

11. The x-ray source of claim 10, wherein:

the x-ray tube includes a cathode and an anode electrically insulated from one another; the cathode configured to emit electrons towards the anode; and the anode configured to emit x-rays out of the x-ray tube in response to impinging electrons from the cathode;

the voltage multiplier includes a negative voltage multiplier and a positive voltage multiplier;

the shell includes a first shell enclosing ≥40% of the negative voltage multiplier and a second shell enclosing ≥40% of the positive voltage multiplier;

the negative voltage multiplier is capable of multiplying an input electrical voltage to produce a negative bias voltage having a value of ≤−2 kV, is electrically coupled to the cathode, and is capable of providing electrical power to the cathode at the negative bias voltage;

the positive voltage multiplier is capable of multiplying an input electrical voltage to produce a positive bias voltage having a value of ≥2 kV, is electrically coupled to the anode, and is capable of providing electrical power to the anode at the positive bias voltage; and a ground plane, being within 100 volts of ground voltage, between the negative voltage multiplier and the positive voltage multiplier.

12. The x-ray source of claim 10, wherein the shell at least partially encloses the voltage multiplier on five sides without enclosing the control circuit.

13. The x-ray source of claim 10, wherein the shell encloses ≥70% of the voltage multiplier without enclosing the control circuit.

14. The x-ray source of claim 10, further comprising a transformer providing electrical power input to the voltage multiplier, the shell enclosing ≥40% of the transformer.

15. The x-ray source of claim 10, wherein the shell blocks at least a portion of electromagnetic interference from the voltage multiplier from interfering with the control circuit.

16. The x-ray source of claim 10, wherein the shell has magnetic permeability of $\geq 5.0\times10^{-5}\mu$.

17. The x-ray source of claim 10, further comprising solid electrically insulative material between the voltage multiplier and the shell.

18. The x-ray source of claim 10, further comprising:

a voltage sensing resistor configured to determine a voltage differential between a cathode and an anode of the x-ray tube; and a casing being electrically conductive and enclosing ≥60% of the voltage sensing resistor without enclosing the electronic circuit.

19. A bipolar x-ray source comprising:

an x-ray tube including: a cathode and an anode electrically insulated from one another; the cathode configured to emit electrons towards the anode; and the anode configured to emit x-rays out of the x-ray tube in response to impinging electrons from the cathode;

a negative voltage multiplier: capable of multiplying an input electrical voltage to produce a negative bias voltage having a value of ≤−2 kV; having an end with a lowest absolute value of voltage, defining a negative low voltage end; and having an end with a highest absolute value of voltage, defining a negative high voltage end, electrically coupled to the cathode and capable of providing electrical power to the cathode at the negative bias voltage;

a positive voltage multiplier: capable of multiplying an input electrical voltage to produce a positive bias voltage having a value of ≥2 kV; having an end with a lowest voltage, defining a positive low voltage end; and having an end with a highest voltage, defining a positive high voltage end, electrically coupled to the anode and capable of providing electrical power to the anode at the positive bias voltage; and a ground plane, being within 100 volts of ground voltage, between the negative voltage multiplier and the positive voltage multiplier.

20. The bipolar x-ray source of claim 19, wherein:

a length of the negative voltage multiplier, a length of the positive voltage multiplier, and a length of the ground plane, are parallel to each other;

the length of the negative voltage multiplier extends from the negative low voltage end to the negative high voltage end;

the length of the positive voltage multiplier extends from the positive low voltage end to the positive high voltage end; and the length of the ground plane is a distance parallel to the length of the negative voltage multiplier, parallel to the length of the positive voltage multiplier, and between the negative voltage multiplier and the positive voltage multiplier.

21. The bipolar x-ray source of claim 20, wherein the length of the ground plane is ≥0.7 times the length of the negative voltage multiplier and ≥0.7 times the length of the positive voltage multiplier 43.

22. The bipolar x-ray source of claim 21, wherein a height of the ground plane is ≥0.7 times a height of the negative voltage multiplier and ≥0.7 times a height of the positive voltage multiplier, the height of the ground plane is perpendicular to the length of the ground plane, and the height of the negative voltage multiplier and the height of the positive voltage multiplier are parallel to the height of the ground plane.

* * * * *